United States Patent [19]

Galis

[11] 4,084,751

[45] Apr. 18, 1978

[54] SELF-PROPELLED MATERIAL STORAGE AND FEEDING VEHICLE

[75] Inventor: Alex J. Galis, Morgantown, W. Va.

[73] Assignee: North American Galis Company, Morgantown, W. Va.

[21] Appl. No.: 712,087

[22] Filed: Aug. 5, 1976

[51] Int. Cl.[2] ..... B02C 13/286

[52] U.S. Cl. ..... 241/25; 241/30; 241/101.7; 241/186 A; 214/17 C; 214/44 A

[58] Field of Search ..... 241/25, 27, 30, 101 R, 241/101.5, 101.7, 186 A, 236, 246, 247, 260.1; 214/17 C, 44 A, 332, 334, 505, 506, 508, 509, 510, 512, 514, 83.18, 83.24, 83.3

[56] References Cited

U.S. PATENT DOCUMENTS

| | | | |
|---|---|---|---|
| 3,889,832 | 6/1975 | Hanson | 214/514 |
| 3,931,936 | 1/1976 | Petry et al. | 241/236 |

*Primary Examiner*—Granville Y. Custer, Jr.
*Attorney, Agent, or Firm*—Stanley J. Price, Jr.; John M. Adams

[57] ABSTRACT

A base member having ground traction devices is connected by an elevation device to a vehicle frame. The vehicle frame supports a feeder portion that includes a fixed storage hopper. A power source for operating the ground traction devices is positioned forwardly of the feeder portion. At the discharging end portion of the feeder portion a pair of scrolls positioned in a trough feed the loose mined material into a breaker unit and therefrom onto a conveyor underlying the vehicle. A movable hopper is positioned for reciprocal longitudinal movement relative to the storage hopper by operation of a pair of piston cylinder assemblies. The movable hopper includes a hinged tailgate operable to move between an open position for loading the vehicle and a closed position for feeding the material to the breaker unit. With the tailgate in the closed position, the movable hopper is advanced the length of the storage hopper forcing the material into the rotating path of the scrolls that feed the material to the breaker unit. To complete the feeding operation the tailgate is advanced the length of the movable hopper discharging the remaining material into the scroll-breaker unit. When the discharging operation is completed, the movable hopper and tailgate return to the receiving end portion of the storage hopper to receive the next load of material from a haulage unit.

13 Claims, 14 Drawing Figures

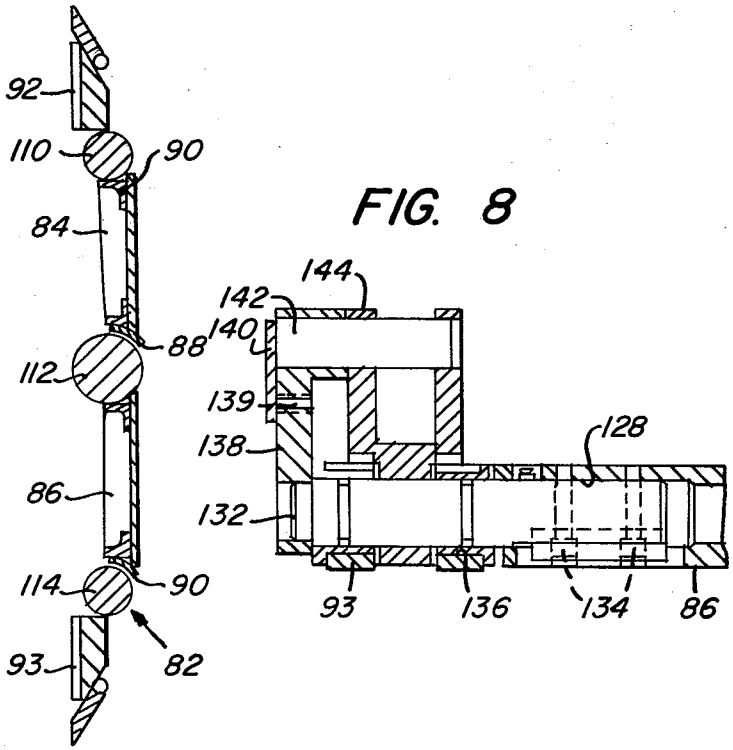
FIG. 8
FIG. 9
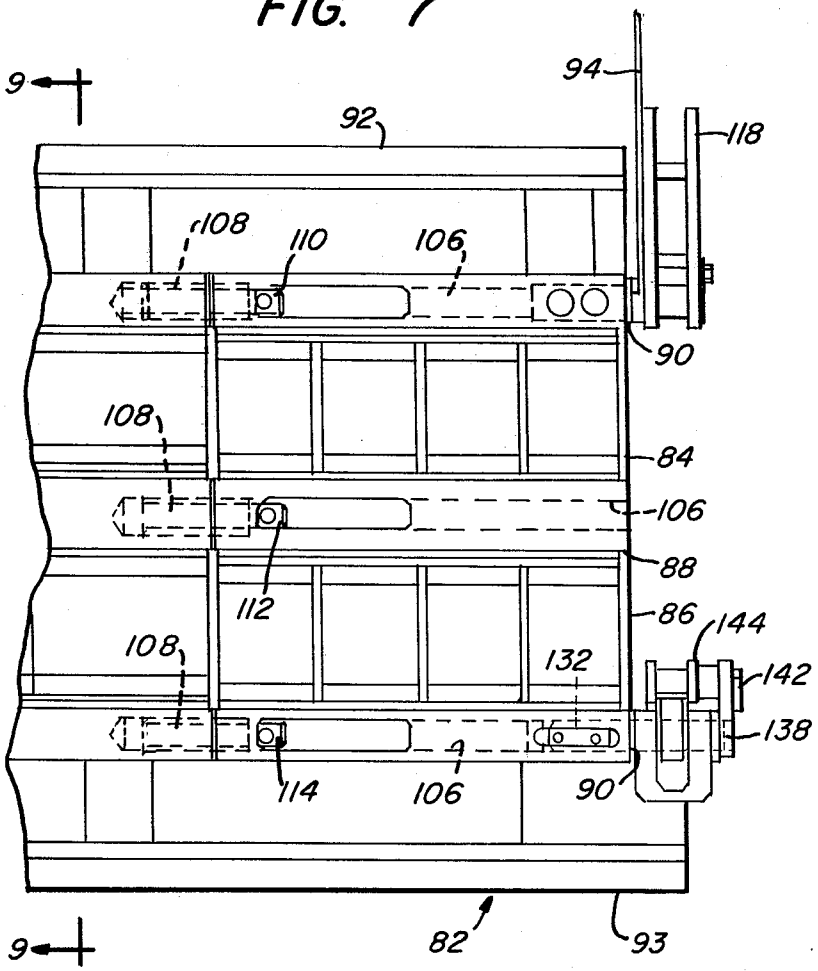
FIG. 7

SELF-PROPELLED MATERIAL STORAGE AND FEEDING VEHICLE

BACKGROUND OF THE INVENTION

1. Field of the Invention

This invention relates to a vehicle for storing and feeding loose mined material and more particularly to a self-propelled material storage and feeding vehicle having a movable hopper positioned within a fixed storage hopper in which the loose material is deposited and fed to a scroll-breaker on the vehicle by advancement of the movable hopper.

2. Description of the Prior Art

Conventional modern continuous mining machines move progressively and continuously into a mine vein. As an integral part of such machines, a rearwardly moving conveyor accepts mined material adjacent the face of the mine and transports it rearwardly through the mining machine for discharge at the rear end thereof. During the operation of the mining machine, the flow of this material emerging from the mining machine conveyor is continuous.

Material emerging from the mining machine is ultimately placed in a haulage vehicle, such as a shuttle car or a haulage vehicle as described in U.S. Pat. Nos. 3,809,262 and 3,826,387 which when filled travels away from the mine area to be unloaded. The mined material is transferred from the haulage vehicle onto a section belt that transports the material out of the mine. A problem is created as a result of the mining machine at one end of the system operating continuously, while the haulage vehicle is available to accept materials only intermittently. Therefore, the haulage vehicle must transfer the loose material onto the section belt at a high rate if the mining machine is to be operated substantially continuously and thereby mine a maximum amount of material within a given time in order to avoid intermittent shutdowns during the travel and unloading period of the haulage vehicle.

At the other end of the system the section belt must operate at a lower rate than the rate of operation of the shuttle car to convey the mined material out of the mine. Therefore, it is necessary for compensation to be made in the material transporting system to permit the continuous operation of the mining machine conveyor. This is accomplished by eliminating delays in unloading the shuttle car at the section belt.

One device for compensating for the time delay created by unloading the shuttle car at the section belt is disclosed in U.S. Pat. Nos. 2,290,950, 2,637,457 and 3,064,837 wherein a storage-loading or surge machine is positioned between the mining machine and the shuttle car and is adapted to receive the mined material from the mining machine conveyor for transfer to the shuttle car. The surge machine provides storage facilities for the loose mined material during the intervals when the shuttle car is unloaded to permit continuous, uninterrupted operation of the mining machine. The surge machine includes a transport conveyor and adjustable devices by which the amount of material entering the storage area and the amount moving onto the shuttle car may be controlled. However, operation of the surge machine in this manner does not relieve the delays encountered by the shuttle car when it transfers the loose material onto a section belt.

In U.S. Pat. Nos. 3,016,204 and 3,047,125 feeder conveyors receive mined materials from a shuttle car and deliver the material at a controlled rate to a main conveyor system. U.S. Pat. No. 3,016,204 discloses a feeder-breaker unit for shattering the larger chunks of mined material into smaller pieces and depositing the smaller pieces upon the conveyor system. Hydraulic cylinders are provided for regulating the height of the conveyor so as to control the rate at which the material is discharged from the storage facility.

Material handling and storage vehicles are also disclosed in U.S. Pat. Nos. 2,637,475, 2,670,836 and 2,753,971 in which one or more conveyors transfer the material the length of the storage bin. Provision is made for regulating the speed of the conveyors to accommodate the transfer of the material through the hopper in synchronization with the shuttle car travel. For example, during the period when the material is stored, the conveyors may operate at a very slow speed to continue to transfer the material from the receiving end to the discharging end of the storage bin. However, systems employing flight conveyors for automatic termination of the discharge must be carefully coordinated with the prime movement of the shuttle car. Due to the inherent problems with flight conveyors as for example repairs to chains, sprockets and other rotating parts, this type of system is relatively inflexible.

An alternative to transporting loose material on a vehicle by a flight conveyor is disclosed in U.S. Pat. Nos. 3,809,262 and 3,826,387 which disclose a self-loading haulage vehicle consisting of a tractor unit joined by an articulated connection with a trailer unit. The trailer unit consists of three hoppers; a stationary hopper, an inner hopper having a cleaner plate which extends into the stationary hopper, and a sump hopper which extends ahead of the stationary hopper and includes a loading gate. In operation the inner hopper is extended and the sump hopper retracted with the loading gate down. The tractor trams the trailer into a pile of loose mined material so that the gate is forced under the material and into the inner hopper. The inner hopper is retracted and the tractor is trammed further into the loose material forcing the material into the stationary hopper. The vehicle makes a third pass in which the tractor again trams into the loose material and the sump hopper is extended and thus loaded. The gate is closed to complete the loading cycle.

There is need for an apparatus for the handling of loose mined material which coordinates the continuous delivery of the loose material from the mining machine onto a haulage vehicle and therefrom onto a conveyor system for movement of the material out of the mine. While it has been suggested to provide intermittent storage capability, the prior art systems require a multiplicity of flight conveyors which must be coordinated with the rate of operation of the haulage vehicle and the rate at which the material is transported by the conveyor system. It is essential that the storage and feeding vehicle be operable to receive material from a haulage unit at a high rate and discharge it to the section belt at a lower rate and thereby provide maximum efficiency without unloading delays.

SUMMARY OF THE INVENTION

In accordance with the present invention, there is provided a self-propelled material storage and feeding vehicle that includes a base mmeber having ground traction means for propelling the base member. An elongated frame is connected to the base member and vertical sidewalls are secured to opposed sides of the frame. A bottom wall interconnects the sidewalls to define a fixed storage hopper. The storage hopper has an open receiving end portion and a closed discharging end portion. An opening is provided in the bottom plate at the discharging end portion. A material breaker unit is rotatably positioned in the storage hopper in overlying relation with the opening. Scroll devices are positioned laterally of the breaker unit and are operable to feed loose material from the bottom plate to the breaker unit. A movable hopper is positioned within the storage hopper for reciprocal longitudinal movement relative thereto. A tailgate is secured to the end of the movable hopper and is operable to move between a first, open position for loading the loose material into the storage hopper and a second, closed position for discharging the loose material from the storage hopper. Fluid actuated mechanisms connected at one end to the frame and at the other end to the movable hopper reciprocate the movable hopper within the storage hopper. In this manner the loose material is fed from the receiving end portion to the discharging end portion into the breaker unit.

The movable hopper includes a pair of vertically extending sidewalls that are transversely interconnected by a bottom plate that is slidable on the bottom plate of the storage hopper. The fluid actuated mechanisms each have an extensible piston rod that is secured to the respective sidewalls. With this arrangement, supplying fluid under pressure to the mechanisms extends and retracts the piston rod to move the sidewalls and bottom plate of the fixed hopper within the storage hopper. The tailgate includes a pair of plate members that are hingedly connected to facilitate movement of the tailgate between the open position and the closed position by operation of fluid actuated piston cylinder assemblies. The tailgate is also movable relative to the bottom plate of the movable hopper by a pair of fluid actuated piston cylinder assemblies that are connected at one end to the tailgate and at the opposite end to a movable frame that is slidable on a track secured to the sidewalls of the movable hopper.

When the movable hopper has traversed the length of the storage hopper and is positioned at the discharging end thereof, the closed tailgate is advanced from the rear of the movable hopper to the front thereof. Loose material remaining on the bottom plate is consequently discharged into the path of the rotating scrolls and fed to the breaker unit which shatters the larger chunks into a suitable particle size before the material is deposited onto a conventional conveyor system that underlies the opening in the bottom plate of the storage hopper.

Initially the vehicle is trammed to a position in which the elongated frame is elevated above a section of a conveyor system so that the loose material discharged through the opening in the bottom plate falls upon the conveyor. With the tailgate in an open position and the movable hopper located at the receiving end portion of the storage hopper, a suitable haulage vehicle with a load of loose mined material advances into the storage hopper and deposits the load. Thereafter the haulage vehicle withdraws from the storage hopper and the tailgate is raised to the closed position to confine the material in the feeder portion. The movable hopper is then advanced from the receiving end portion to the discharging end portion of the storage hopper, and the loose material ahead of the movable hopper is directed into the scroll-breaker. When the movable hopper has completed its forward movement, the tailgate is actuated to move in the closed position through the movable hopper feeding the remaining material into the scroll-breaker. When the discharging operation is completed, the movable hopper and tailgate are returned to the initial loading position at the receiving end of the storage hopper.

Accordingly, the principal object of the present invention is to provide a self-propelled material storage and feeding vehicle for receiving loose mined material at a high rate from a haulage unit and discharging the material at a lower rate onto a conveyor system for movement out of the mine.

Another object of the present invention is to provide a storage and feeding vehicle having a movable hopper positioned within a fixed storage hopper in which a haulage unit is advanced into the storage hopper and deposits a load of loose mined material thereon with the material being fed the length of the storage hopper by a movable hopper through a scroll-breaker unit onto a conventional conveyor system for movement out of the mine.

A further object of the present invention is to provide a storage and feeding vehicle that may be easily maneuvered in an underground mine at a given seam hieght to receive loose mined material in a haulage vehicle at the maximum rate thereof and provide a wide range of rates at which the material may be discharged onto a section belt for transporting the material from the mine without delay in transferring the material from the haulage vehicle to the section belt.

Another object of the present invention is to provide a storage and feeding vehicle for receiving loose mined material at a maximum rate and discharging the material at a minimum rate by movement of a hopper within a fixed storage hopper in which a tailgate associated with the movable hopper cleans the remaining material from the storage hopper.

These and other objects of the present invention will be more completely described and disclosed in the following specification, the accompanying drawings and the appended claims.

BRIEF DESCRIPTION OF THE DRAWINGS

FIG. 7 is a bottom view of the hinged tailgate taken along line 7—7 of FIG. 6.

FIG. 8 is an enlarged sectional view taken along line 8—8 of FIG. 6 of the connection of the rear tailgate plate with the tailgate end piece.

FIG. 9 is a sectional view of the hinged tailgate taken along line 9—9 of FIG. 7.

DESCRIPTION OF THE PREFERRED EMBODIMENT

Figure 1:
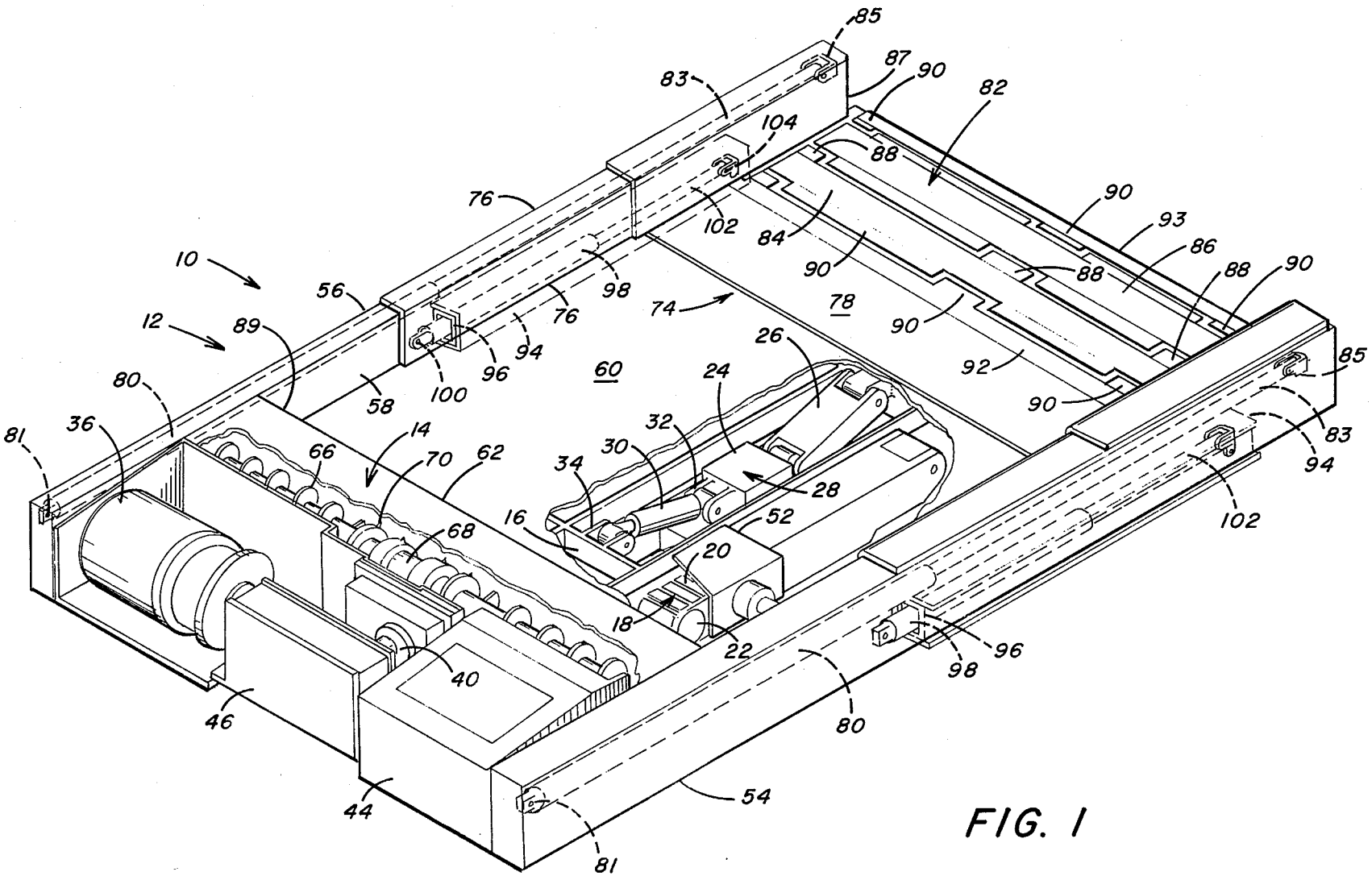
FIG. 1 is a isometric view of the material storage and feeding vehicle of the present invention, illustrating the ground traction mechanism for propelling the vehicle.
Figure 2:
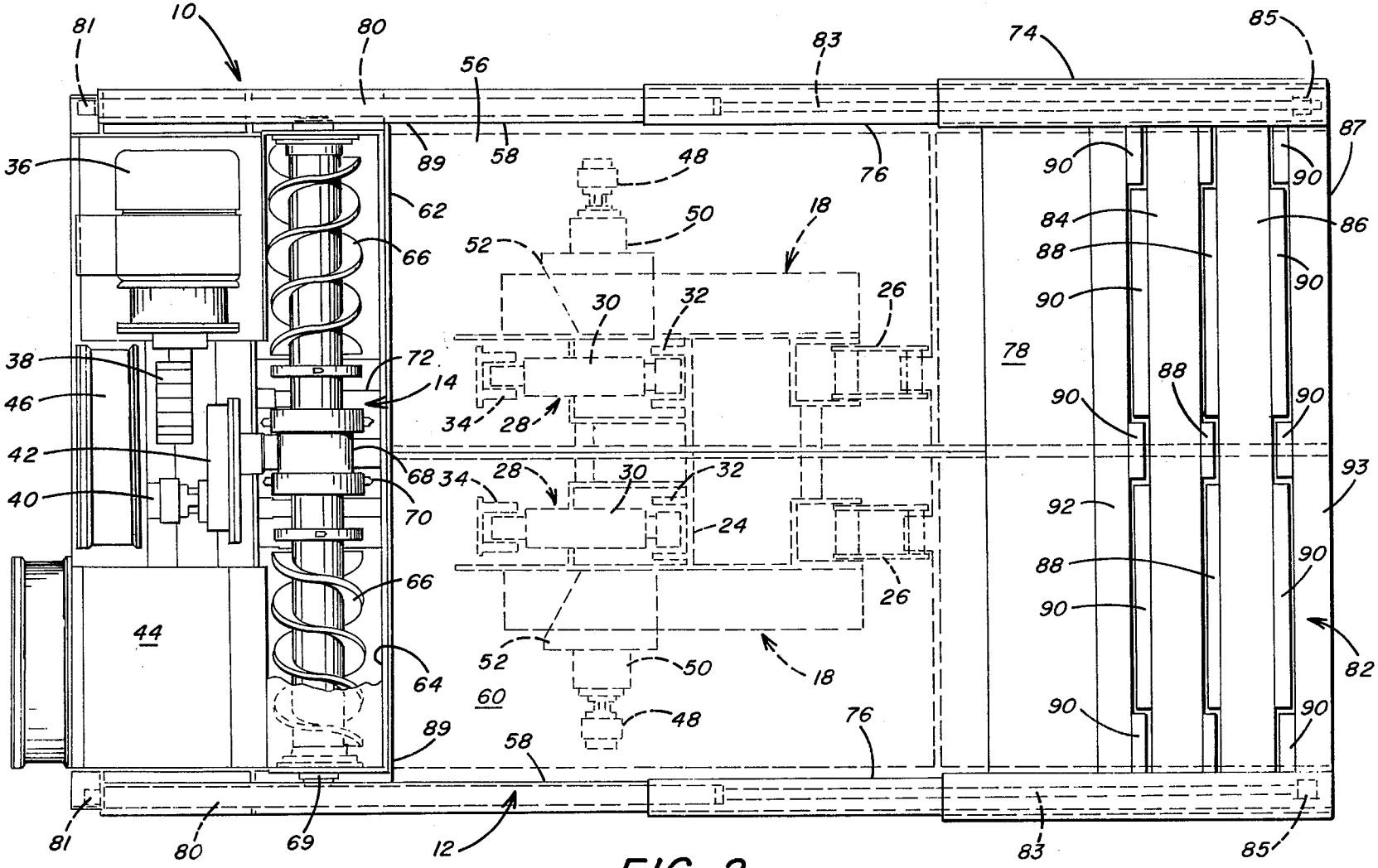
FIG. 2 is a top plan view of the material storage and feeding vehicle, illustrating a movable hopper positioned within a fixed storage hopper for receiving a load of loose mined material for discharge through a scroll-breaker unit onto a conveyor positioned therebelow to transport the material out of the mine.
Figure 3:
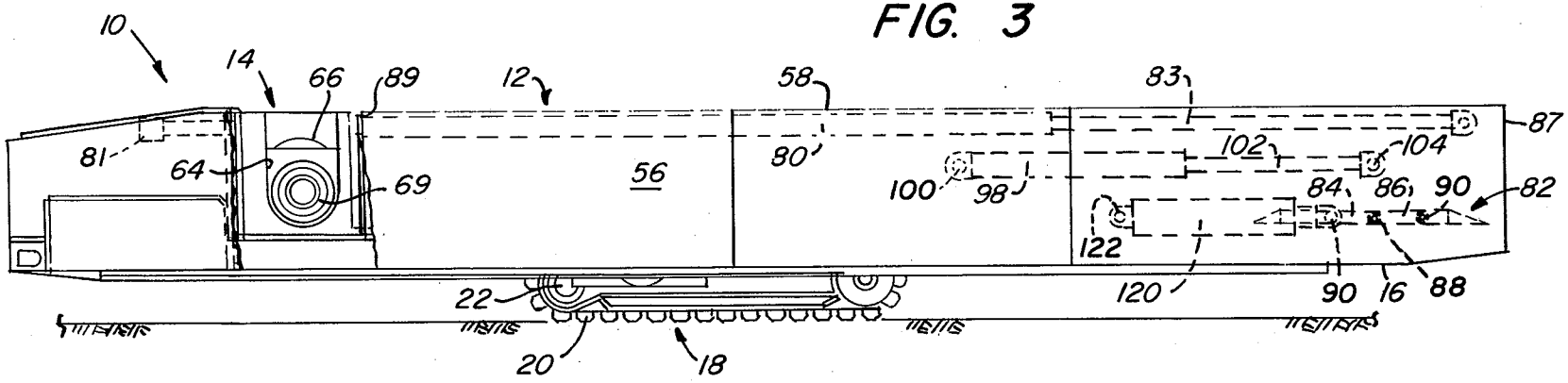
FIG. 3 is a view in side elevation of the material storage and feeding vehicle shown in FIG. 2, illustrating the tailgate of the movable hopper in position for receiving a load of mined material.
Figure 10:
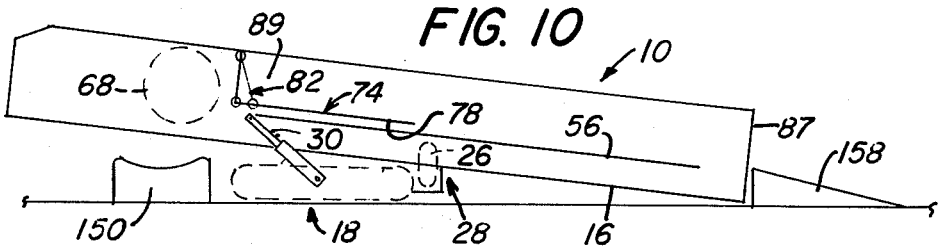
FIG. 10 is a schematic representation of the material storage and feeding vehicle, illustrating the vehicle elevated in a position overlying a conveyor belt onto which the loose material is deposited by forward movement of the movable hopper and the tailgate relative to the movable hopper.
Figure 11:
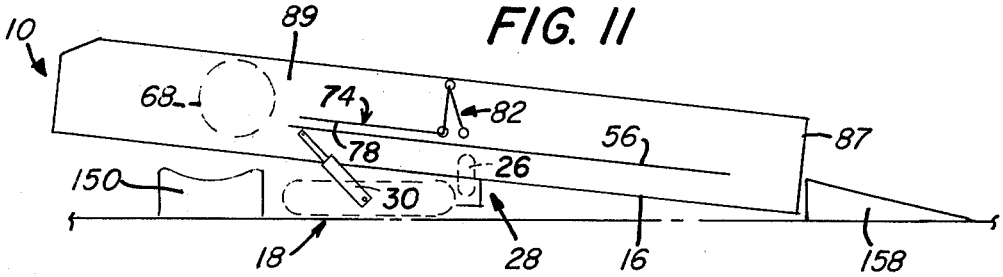
FIG. 11 is a schematic representation similar to FIG. 10, illustrating the movable hopper positioned at the discharging end of the storage hopper with the tailgate in position to advance through the movable hopper.
Figure 12:
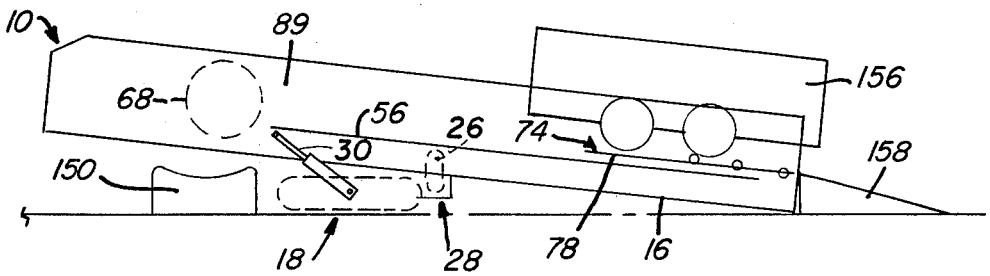
FIG. 12 is a schematic representation of a conventional haulage vehicle trammed into the storage and feeding vehicle, illustrating the movable hopper at the receiving end of the stationary hopper and the tailgate lowered to the open position to accommodate unloading of the haulage vehicle.
Figure 13:
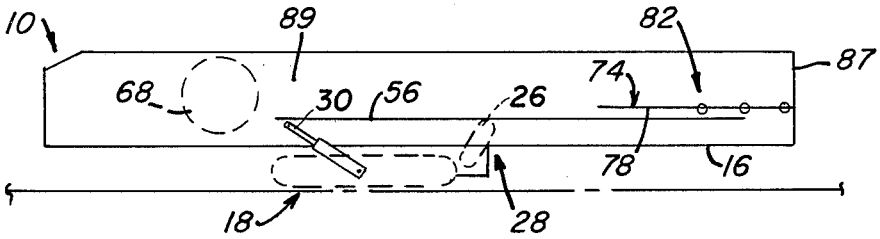
FIG. 13 is a schematic representation of the storage and feeding vehicle in a high tram position for movement through the mine.
Figure 14:
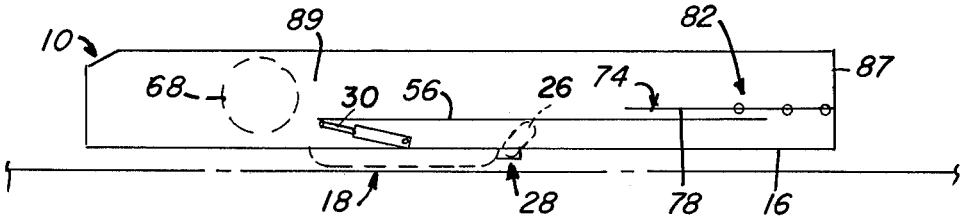
FIG. 14 is a view similar to FIG. 13, illustrating the vehicle lowered to a low tram position.

Referring to the drawings and particularly to FIGS. 1–3, there is illustrated a self-propelled material storage and feeding vehicle generally designated by the numeral 10 that includes a feeder portion 12 and a breaker portion 14 positioned forwardly of the feeder portion in which the feeder and breaker portions are mounted on an elongated vehicle frame 16. The vehicle frame 16 is, in turn, supported by ground traction devices, such as the track assembly, generally designated by the numeral 18. The track assembly includes a pair of ground engaging tractor treads 20 (one of which is illustrated in FIGS. 1 and 3) passing around driven sprockets 22. The tractor treads 20 are transversely interconnected by a base member 24, illustrated in FIG. 1. The base member 24 is pivotally connected by horizontal pivots to one end of a pair of connecting link members 26 which are secured at the opposite end to the vehicle frame 16. With this arrangement the frame 16 is connected by the link members 26 to the base member 24 for pivotal movement about a horizontal axis to be raised to a preselecteed height relative to the base member 24. The vehicle frame 16 is first raised and lowered as illustrated in FIGS. 13 and 14 relative to the base member 24 by actuation of elevation devices 28 to pivot the link members 26 about the base member 24. Further, actuation of devices 28 pivots the link members 26 to tilt the frame 16 and move the feeder portion 12 and breaker portion 14 to an inclined position, as illustrated in FIGS. 10–12.

Each of the elevation devices 28 includes a piston cylinder assembly 30 pivotally connected at one end to a bifurcated member 32 that is secured to the base member 24. An extensible piston rod (not shown) of the piston cylinder assembly 30 is connected by a frame 34 to the vehicle frame 16. Extension of the piston rod of each of the assemblies 30 exerts an upward force upon frame 16. With the assemblies 30 supported by the base member 24, extension of the piston rods urges the link members 26 to pivot upwardly about the base member 24. This moves the frame 16 connected to the link members 26 upwardly relative to the base member 24. Thus in operation when fluid under pressure is supplied to the piston cylinder assemblies 30, the piston rods thereof initially extend outwardly to vertically raise the vehicle frame 16 by pivoting of the link members 26 on base member 24. With the frame vertically raised to a preselected height, continued actuation of assemblies 30 tilts the frame 16 to move the feeder 12 and breaker 14 to an inclined position. In this manner, as will be later explained in greater detail, the feeder portion 12 may be selectively positioned to facilitate loading of mined material into the vehicle 10. This arrangement also facilitates tramming of the vehicle 10 when empty at an elevation determined by the overhead clearance.

The vehicle frame 16 is propelled by the track assembly 18 which is, in turn, powered by a main power source, such as an electric motor 36 positioned forwardly of the breaker portion 14. Electrical power is supplied to motor 36 through an electrical cable (not shown) wound upon a cable reel. The electric motor operates a fluid pump 38 and supplies fluid under pressure to a hydraulic motor 40 that is drivingly connected through a speed reducer 42 to the breaker portion 14. The fluid pump 38 supplies fluid, such as hydraulic oil, from a tank 44 located on the vehicle frame 16 to the various fluid actuated piston cylinder assemblies of the vehicle 10. Suitable fluid valves and controls therefore for supplying fluid at desired pressure to the selected cylinders are provided at a control station 46 which includes both electric controls and hydraulic controls. The control station 46 also includes a controller comprising switches and controls by which the speed and direction of operation of the vehicle 10 is regulated.

Each track assembly 18 of the vehicle 10, as illustrated in FIGS. 1 and 2, is driven by a hydraulic motor 48 through a conventional speed reducer 50 that is drivingly connected to the track assembly 18 and is supported on the base member 24 by brackets 52.

The vehicle frame 16 mounted on the track assembly 18 includes a longitudinally extending body portion 54 that supports the feeder portion 12. The feeder portion 12 includes a fixed storage hopper 56 defined by parallel spaced, vertically extending sidewalls 58 that are interconnected by a bottom plate 60. The storage hopper includes a front end portion 62 and extends therefrom to an open end portion into which the loose mined material, such as coal, is deposited. A transversely extending trough 64 is positioned transversely relative to the feeder portion 12 forward of the front end portion 62. The breaker portion 14 is positioned within the trough 64 and includes a pair of scrolls 66 that are rotatably supported by bearings 69 to feed the loose material to a breaker unit 68.

The breaker unit 68 includes a cylindrical drum having a plurality of cutter bits 70 positioned on the periphery thereof. The breaker unit 68 is rotatably driven to shatter the larger chunks of mined material into small chunks by the action of the cutter bits 70 engaging the larger chunks between the breaker unit 68 and the walls of the trough 64. The shattered material passes through an opening 72 in the trough 64 onto the conveyor surface of a section belt that transports the loose material from the mine.

A movable hopper generally designated by the numeral 74 in FIGS. 1, 2 and 10–14 is provided in the feeder portion 12 of the vehicle 10 and includes a pair of vertically extending spaced sidewalls 76 that are transversely connected by a bottom plate portion 78. The movable hopper is arranged to move reciprocally longitudinally within the fixed storage hopper 56 by operation of a pair of fluid actuated piston cylinder assemblies 80. Preferably, the piston cylinder assemblies 80 are positioned parallel to sidewalls 58 of the storage hopper 56 within the body portion 54 to protect the assemblies 80 from the mine material in hopper 56. The cylinders 80 are secured to the vehicle body portion 54 at one end in a conventional manner, as by pins or bolts 81. Each assembly 80 includes an extensible piston rod 83 connected at its end portion to a clevis 85 that is welded to the sidewalls 76 of movable hopper 74.

Actuation of the piston cylinder assemblies 80 extends and retracts the piston rods 83 to move the hopper 74 reciprocally longitudinally with respect to the storage hopper 56. The bottom plate 78 moves over the bottom plate 60 and the sidewalls 76 of hopper 74 being positioned inboard of sidewalls 58 move longitudinally relatively thereto. The movable hopper 74 is thus operable to advance in this manner from the receiving end portion 87 of the feeder portion 12 to the discharging end portion 89 and transfer the loose mined material from the haulage vehicle onto the conveyor underlying the breaker portion 14.

A tailgate 82 is movably positioned on the bottom plate 78, in a manner hereinafter explained, to move longitudinally between the sidewalls 76. The tailgate 82 is arranged to assume a first horizontal open position to aid in loading the feeder portion 12 and a second closed vertical position to aid in feeding the loose material to the breaker portion 14. Further, the tailgate 82 is movable reciprocally longitudinally relative to the movable hopper 74 so that when the hopper 74 is advanced to the discharging end portion 89 the tailgate 82 is operated to move from the rear of the movable hopper 74 to the front thereof. This cleans the bottom plate 78 so that all loose material is discharged into the breaker unit 68.

As illustrated in FIGS. 1 and 2, and in greater detail in FIGS. 4–9, the tailgate 82 includes a pair of plate members 84 and 86 that are connected by a plurality of hinge connections 88 (as will be further explained in greater detail). The hinged plates 84 and 86 move the tailgate 82 from the horizontal open position illustrated in FIG. 1 to the vertical closed position, as illustrated in phantom in FIG. 4. As illustrated in FIGS. 1 and 2, the tailgate plate members 84 and 86 are connected to the tailgate end pieces 92 and 93 by hinges 90.

Figure 4:
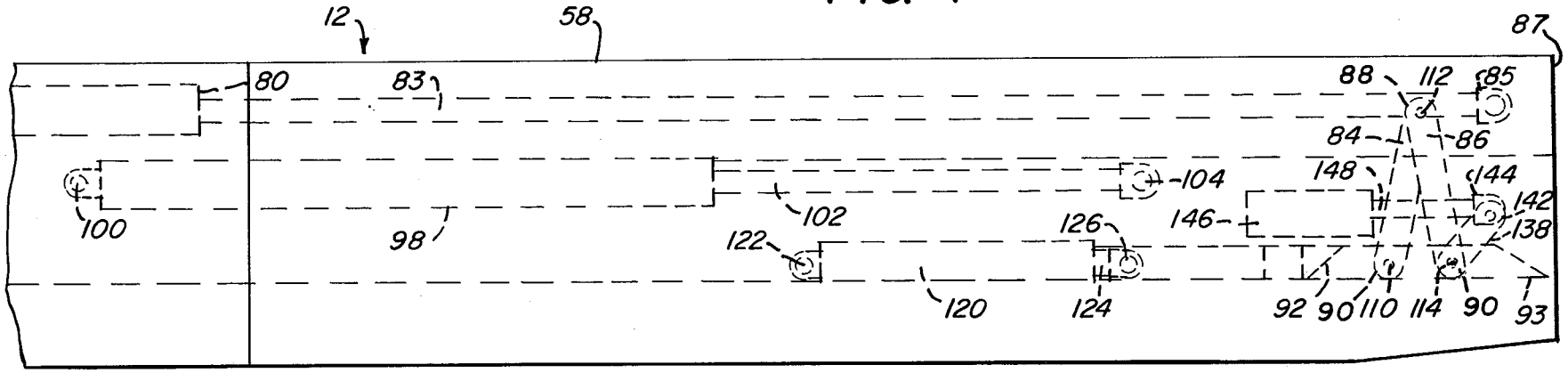
FIG. 4 is a fragmentary view in side elevation of the movable hopper, illustrating the fluid operated piston cylinders for longitudinally reciprocating the movable hopper and operating the tailgate in the open and closed positions.
Figure 5:
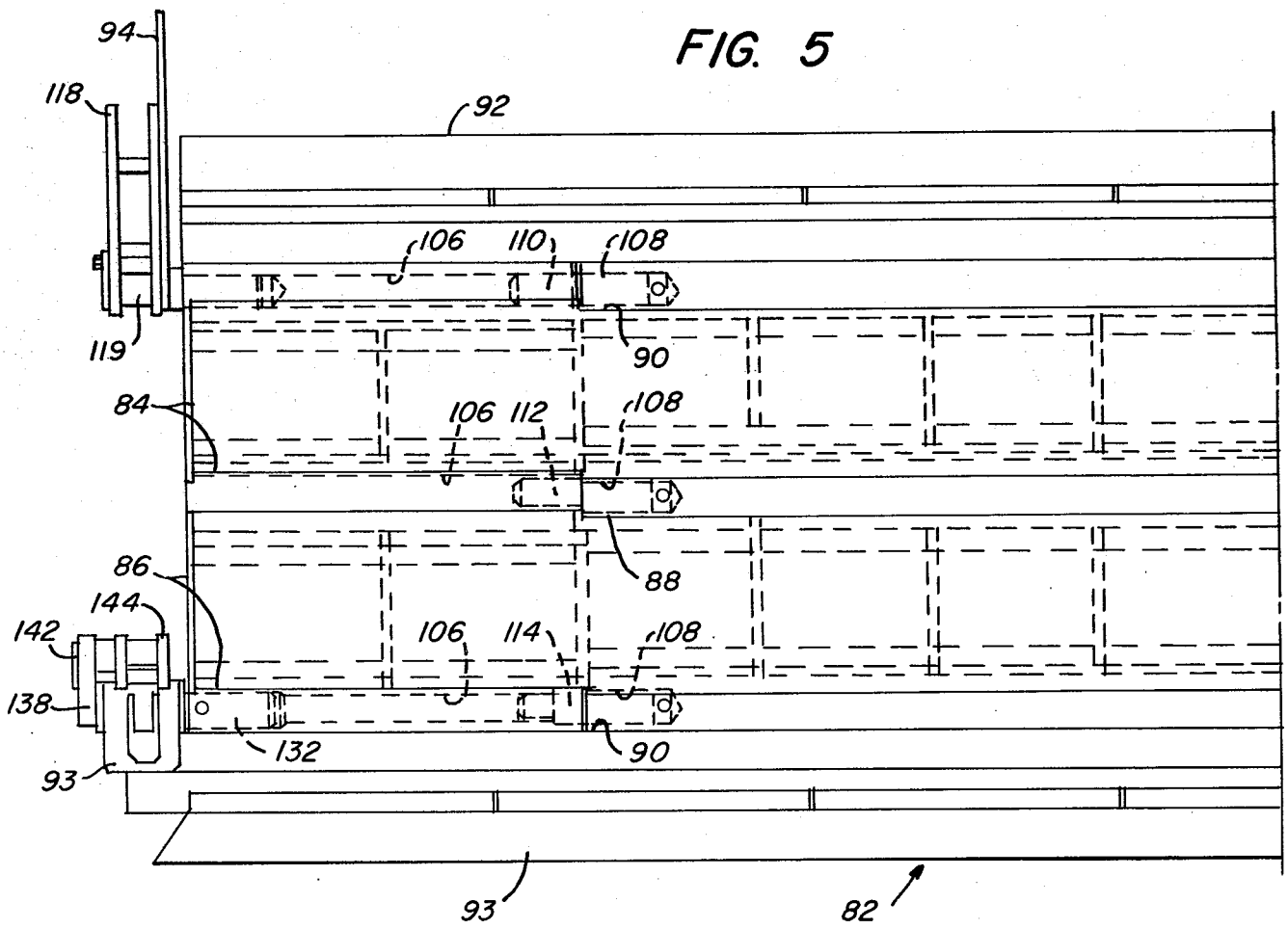
FIG. 5 is a fragmentary top plan view of the tailgate for closing the storage hopper, illustrating the hinged connections of the tailgate plates.

The tailgate assembly 82 is secured to a movable member 94 that is slidable on a track 96 that is mounted to each sidewall 76 as shown in FIG. 1. The member 94 is movably positioned inboard of sidewall 76 which, in turn, is movably positioned within the sidewall 58 of feeder portion 12. The member 94 is positioned above the bottom plate 78 and is also movable relative thereto. The movable members 94 are channel shaped to conform to the configuration of the track 96. The movable members 94 are longitudinally reciprocated by operation of piston cylinder assemblies 98 (one of which is shown in FIGS. 1 and 4) that are positioned adjacent the sidewalls 76 of movable hopper 74 and inboard of sidewalls 58 above the bottom plate 60 of the feeder portion 12. Each assembly 98 is rigidly secured at the cylinder end by a pin 100 to the sidewall 76 of the movable hopper 74. Each of the assemblies 98 also includes an extensible piston rod 102 that is connected by pin 104 to the movable member 94. Thus, when the hinged tailgate 82 is vertically raised to the closed position, as indicated in FIG. 4, actuation of the cylinders 98 to retract the piston rod 102 forwardly advances the movable member 94 on track 96 and moves the talgate 82 forwardly relative to the bottom plate 78. In this manner loose material is ejected from the bottom plate 78.

Figure 6:
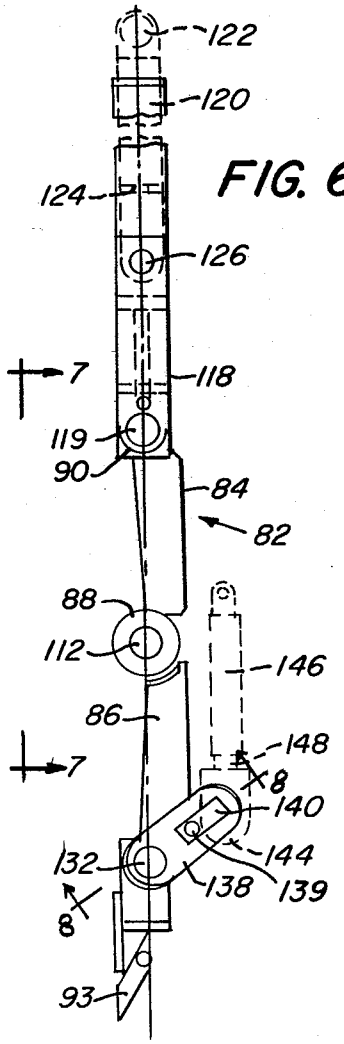
FIG. 6 is a view in side elevation of the tailgate shown in FIG. 5, illustrating the fluid actuated piston cylinder assemblies for moving the hinged tailgate between an open position as shown and a closed position.

The structure of the tailgate 82 is illustrated in greater detail in FIGS. 5–9 in which the tailgate plate members 84 and 86 are connected by hinges 88, and plates 84 and 86 are connected to end pieces 92 and 93 respectively by hinges 90. The hinges 88 and 90 include aligned cylindrical bores 106 and 108 for receiving sets of hinge pins 110, 112 and 114 that extend through the bores 106 and 108. A clevis 118 is positioned laterally of the tailgate end piece 92 and adjacent to the movable member 94. A pin 119 extends outwardly from the clevis 118 and is retained within the bore 106 of the hinge 90 that connects plate 84 with end piece 92 to connect clevis 118 to hinge 90. The clevis assembly is, in turn, positioned within the movable member 94 and slidable on the track 96 so that the hinge pins 110 remain adjacent the bottom plate 78 of the movable hopper 74 when the tailgate is raised to the closed position. As illustrated in FIG. 6, a piston cylinder assembly 120 has one end portion rigidly secured by a pin 122 to the movable member 94 inboard of sidewall 76. An extensible piston rod 124 connected by pin 126 to the clevis assembly 118 so that the assembly 120 is operable upon actuation to raise and lower the plate member 84 to aid in moving the tailgate 82 between the open and closed positions.

The tailgate plate member 84 and 86 are connected at their adjacent end portions by the set of hinge pins 112 that pass through the aligned bores 106 and 108. The hinge plate 86 is connected at its opposite end portion to the end peice 93 by the set of hinge pins 114 extending through the aligned bores 106 and 108 of hinge plate 96 and end piece 93 respectively.

As illustrated in FIGS. 6 and 8, a pair of pins 132 (one of which is shown) positioned in bores 128 extend outwardly from the edges of the plate member 86 and are secured thereto by bolts 134. The pins 132 extend into bores 136 of end piece 93. The end of each of the pins 132 is secured, as by welding, to the end of an arm member 138. The opposite end of the arm member 138 receives a pin 139 of member 140 which is welded to a pin 142 that extends through aligned bores of a clevis 144. A piston cylinder assembly 146 is connected at the cylinder end thereof to the movable member 94 and includes an extensible piston rod 148 having an end portion that is connected by the pin 142 to the clevis 144. With this arrangement actuation of the piston cylinder assemblies 146 to extend and retract the piston rod 148 rotates the pin 132 through arm member 138 and raises and lowers the tailgate plate 86. Thus, operation of the piston cylinder assemblies 120 and 146 together raise and lower the tailgate plates 84 and 86 about the hinge connections 88 with the hinge connections 90 remaining adjacent the bottom plate 78.

As illustrated in FIG. 6 with the hinge connections 88 and 90 adjacent the bottom plate 78 of the movable hopper 74, the tailgate 82 is in an open position to receive a load of mined material from a haulage vehicle. Actuating the cylinders 120 and 146 to vertically raise the hinge connections 88 serves to close the rear of the movable hopper 74 and confines the loose material therein. The tailgate is shown in the closed position in FIG. 4. Thereafter, actuation of the piston cylinder assembly 98 to retract the piston rod 102 forwardly advance the movable member 94 to move the tailgate 82 in the closed position from the rear of the hopper 74 to the front of the hopper 74. The forward movement of the tailgate 82 in the closed position serves to clean the bottom plate 78 of material and complete the discharging operation. Thus, when the movable hopper 74 is advanced to the discharging end portion 89 of the storage hopper 56, longitudinal movement of the tailgate 82 in the closed position feeds the material remaining in the feeder portion 12 into the path of the rotating scrolls 66 for conveyance to the breaker unit 68.

With reference to FIGS. 10–14, the method of operation of the self-propelled material storage and feeding vehicle 10 is schematically illustrated in which the vehicle is initially positioned for tramming, as illustrated in FIGS. 13 and 14 where the feeder portion 12 is selectively vertically raised and lowered by the elevation device 28 described hereinabove and illustrated in FIG. 1 to a preselected elevation as determined by the height of the coal seam in the mine where the vehicle 10 is operating. In the tramming position the vehicle frame 16 is positioned substantially parallel to the mine floor, as illustrated in FIGS. 13 and 14. The tailgate 82 is lowered at the receiving end portion 87 by extension of piston rods 148 of assemblies 146 and retraction of piston rods 124 of assemblies 120. Thereafter, with the movable hopper 74 at the receiving end portion 87, the vehicle frame 16 is moved to an inclined position by further actuation of the elevation device 28 to move the breaker portion 14 into overlying relationship with a section belt 150 of a conventional conveyor system that transports the loose mined material out of the mine as illustrated in FIGS. 10–12.

The feeder portion 12 is loaded, as illustrated in FIG. 12, by advancement of a haulage vehicle 156 containing mined material up a ramp 158 into the receiving end portion 87 onto the bottom plate 78 of the movable hopper 74. In accordance with the present invention the haulage vehicle 156 may be any suitable haulage vehicle such as a shuttle car, or a vehicle of the type illustrated and described in U.S. Pat. Nos. 2,809,262 and 3,826,387. The haulage vehicle 156, positioned within the feeder portion 12, discharges its load therein and, thereafter, is withdrawn from the feeder portion 12. The assemblies 120 and 146 are actuated to raise the tailgate 82 to a closed position. The piston cylinder assemblies 80 are then actuated to retract the piston rods 83 thereof to advance the movable hopper 74 from the receiving end 87 to the discharging end 89 as illustrated in FIG. 11.

The material remaining in the feeder portion 12 on the bottom plate 78 is discharged into the path of the rotating breaker unit 68 by forward movement of the tailgate 82 in the raised position by actuation of the pinton cylinder assemblies 98. Retraction of the piston rods 102 advances the raised tailgate 82 from one end of the movable hopper 74 to a position adjacent the breaker unit 68, as illustrated in FIG. 10. The loose material positioned on the bottom plate 78 is conveyed by the forwardly advancing tailgate 82 into the breaker unit 68. From the breaker unit 68 the shattered material passes onto the surface of the section belt 150 for conveyance out of the mine.

To facilitate reloading of the feeder portion 12, the movable hopper 74 is moved from the discharging end portion 89 as illustrated in FIG. 10 to the receiving end portion 87 as illustrated in FIG. 12 by operation of the piston cylinder assemblies 80 to extend the piston rods 83. The tailgate 82 during this operation is advanced to the opposite end of the movable hopper 74 by extension of piston rods 102 of assemblies 98. The tailgate 82, by operation of assemblies 120 and 146, is lowered to the open position to permit loading of the feeder portion 12 by advancement of the loaded haulage vehicle 156 up the ramp 158 into the receiving end portion 87 onto the bottom plate 78 of the movable hopper 74. The vehicle 10 is then returned to the tramming position illustrated in FIGS. 13 and 14 by lowering the elevation device 28 to complete the sequence of steps in loading and unloading the vehicle 10.

It is the practice in coal mining operations to transport material dislodged by the mining machine in a haulage vehicle. Accordingly, the rate at which the mining machine operates to dislodge the material from the mine is determined in part by the rate at which the loose material is transported from the discharging conveyor of the mining machine. Therefore, delays in transferring the mined material from the mining machine to the haulage vehicle will interrupt operation of the mining machine which is to be operated substantially continuously. To avoid intermittent shutdowns during the travel and unloading of the haulage vehicle, the storage and feeding vehicle 10 stores the mined material to allow the haulage vehicle 156 to operate at maximum efficiency. Accordingly, in order to accommodate the rate at which the section belt 150 transports the mined loose material from the vehicle 10, the vehicle 10 serves as a surge bin receiving the material from the haulage unit at a high rate, and discharging it to the belt at a lower rate.

It will be apparent from the present invention that the rate of discharge of the loose material from the feeder portion 12 may be selectively controlled and varied during operation by adjusting the flow of hydraulic fluid to the piston cylinder assemblies 80, 98, 120 and 146. In this manner the rate at which the loose material is fed onto the section belt 150 is controllable to meet the operating conditions, such as the height of the mineral seam being mined, the rate at which the material is dislodged from the mine face, the travel time for a complete cycle of the haulage vehicle between the mining machine and the storage and feeding vehicle 10, and the rate at which the material is transported by the section belt 150.

Not only is the self-propelled material storage and feeding vehicle operable to function as a surge bin in receiving material from a haulage vehicle at a high rate and discharging it onto a belt at a lower rate, it also is readily adaptable for for movement from point to point in a mine in accordance with the overhead clearance available for tramming. This advantage is illustrated by FIGS. 13 and 14 in which the feeder portion 12 may be sufficiently raised by the elevation device 28 to permit a high tram position of the vehicle 10. However, where conditions demand by virtue of a seam of minimum height, the feeder portion 12 may be lowered relative to the track assembly 18 to a low tram position as illustrated in FIG. 14. This is accomplished by actuating the elevation device 28 to lower the vehicle frame 16. Thus, it will be apparent from the present invention that a versatile self-propelled material storage and feeding vehicle is provided to efficiently coordinate operation of a haulage vehicle with a section belt in mines of varying seam height.

According to the provisions of the patent statutes, I have explained the principle, preferred contruction and mode of operation of my invention and have illustrated and described what I now consider to represent its best embodiments. However, it should be understood that within the scope of the appended claims, the invention may be practiced otherwise than as specifically illustrated and described.

I claim:

1. A self-propelled material storage and feeding vehicle comprising,
   a base member having ground traction means for propelling said base member,
   an elongated frame connected to said base member,
   vertical sidewalls secured to opposed sides of said frame and a bottom plate interconnecting said sidewalls to define a fixed storage hopper,
   said storage hopper having an open receiving end portion and a discharging end portion,
   a material breaker unit supported by said elongated frame forwardly of said storage hopper discharging end portion in overlying relation with said opening,
   scroll means positioned laterally of said breaker unit for feeding loose material thereto,
   a movable hopper positioned within said storage hopper for reciprocal longitudinal movement relative thereto,
   a tailgate secured to the end of said movable hopper and operable to move between an open position for loading loose material into said fixed storage hopper and a closed position for discharging the loose material from said storage hopper, and
   fluid actuated means connected at one end to said frame and at the other end to said movable hopper for reciprocating said movable hopper within said storage hopper to feed the loose material from said receiving end portion into said breaker unit.

2. A self-propelled material storage and feeding vehicle as set forth in claim 1 which includes,
   a bottom plate of said movable hopper longitudinally reciprocal relative to said bottom plate of said storage hopper to advance loose material loaded therein from said receiving end portion to said discharging end portion.

3. A self-propelled material storage and feeding vehicle as set forth in claim 1 which includes,
   means for connecting said tailgate to said movable hopper for reciprocal movement of said tailgate relative thereto such that loose material in said movable hopper is discharged therefrom by said tailgate in said closed position.

4. A self-propelled material storage and feeding vehicle as set forth in claim 3 which includes,
   a track assembly secured to and extending the length of said movable hopper,
   a channel shaped frame movably positioned on said track,
   said tailgate being hingedly connected to said movable frame, and
   fluid actuated means secured to said movable hopper and to said movable frame for moving said movable frame on said track to longitudinally reciprocate said tailgate the length of said movable hopper.

5. A self-propelled material storage and feeding vehicle as set forth in claim 4 which includes,
   said tailgate being longitudinally movable relative to said movable hopper in said closed position whereby material in said movable hopper may be discharged therefrom.

6. A self-propelled material storage and feeding vehicle as set forth in claim 1 in which said movable hopper includes,
   a pair of spaced vertical sidewalls positioned within and parallel to said sidewalls of said storage hopper,
   said pair of spaced vertical sidewalls being interconnected by a bottom plate,
   said movable hopper bottom plate being positioned in overlying relation with said bottom plate of said storage hopper and movable relative thereto, and
   said fluid actuated means being secured to said movable hopper sidewalls such that upon actuation thereof said movable hopper sidewalls and bottom plate move relative to said storage hopper sidewalls and bottom plate to feed the loose material loaded into said storage hopper from the receiving end portion to the discharging end portion.

7. A self-propelled material storage and feeding vehicle as set forth in claim 1 which includes,
   a first pair of piston cylinder assemblies connected to said movable hopper and to said tailgate for raising and lowering said tailgate to said closed position and said open position, and
   a second pair of piston cylinder assemblies connected to said movable hopper and said tailgate for moving said tailgate in said closed position longitudinally reciprocally relative to said movable hopper.

8. A self-propelled material storage and feeding vehicle as set forth in claim 1 which includes,
   said tailgate having a pair of plate members extending transversely relative to said movable hopper,
   means for hingedly connecting said plate members to each other, and
   piston cylinder means connected to said movable hopper and to each of said plate members for raising and lowering said plate members about the hinged connections thereof to move said tailgate between said closed and opened positions.

9. A self-propelled material storage and feeding vehicle as set forth in claim 1 which includes,
   elevation means connecting said base member to said elongated frame for raising and lowering said elongated frame relative to said base member, and
   said elevation means operable to position said frame at a preselected elevation for tramming and at a preselected angle relative to said ground traction means.

10. A method for storing and feeding material on a self-propelled vehicle comprising,
   positioning a feeder portion of said vehicle in overlying relation with conveying means,
   moving a movable hopper to the receiving end of a fixed storage hopper on said feeder portion,
   lowering a tailgate of said movable hopper to an open position to permit a haulage vehicle to enter said feeder portion and deposit a load of mined material into said receiving end portion,
   advancing said movable hopper forwardly within said storage hopper to feed the mined material from said receiving end portion to a discharging end portion of said storage hopper, and
   discharging the mined material into a breaker portion positioned adjacent said discharging end portion to shatter the mined material into a selected particle size for transfer onto said conveying means.

11. A method for storing and feeding material on a self-propelled vehicle as set forth in claim 10 which includes, raising said tailgate to a closed position after loading said feeder portion, and maintaining said tailgate in said closed position to confine the mined material within said movable hopper as said movable hopper feeds the mined material to said breaker portion.

12. A method for storing and feeding material on a self-propelled vehicle as set forth in claim 10 which includes, advancing said tailgate forwardly on said movable hopper to push the mined material remaining in said movable hopper into said breaker portion and thereby clean said movable hopper, and retracting said movable hopper and said tailgate to the receiving end portion of said storage hopper.

13. A method for storing and feeding material on a self-propelled vehicle as set forth in claim 10 which includes, raising said feeder portion to a preselected inclined position relative to said conveying means, advancing the haulage vehicle containing a load of mined material into said storage hopper, unloading the mined material into said storage hopper, withdrawing the haulage vehicle from said storage hopper, raising said tailgate to a closed position, and advancing said movable hopper from said receiving end portion of said storage hopper to said discharging end portion thereof at a preselected rate to direct the mined material into said breaker portion.

* * * * *